US005239938A

United States Patent [19]

Spradley

[11] Patent Number: 5,239,938

[45] Date of Patent: Aug. 31, 1993

[54] QUICK-CONNECT BOOM END

[76] Inventor: Bruce S. Spradley, 5336 Finsbury Ave., Sacramento, Calif. 95841

[21] Appl. No.: 941,883

[22] Filed: Sep. 8, 1992

[51] Int. Cl.[5] ..... B63B 35/79

[52] U.S. Cl. ..... 114/97; 114/39.2

[58] Field of Search ..... 114/39.2, 97

[56] References Cited

U.S. PATENT DOCUMENTS 4,635,579 1/9185 Marker et al. .
4,696,248 12/1985 Nedoluha .
5,095,838 1/1988 Smith .

FOREIGN PATENT DOCUMENTS 2900908 7/1980 Fed. Rep. of Germany ..... 114/97
3801664 7/1989 Fed. Rep. of Germany ..... 114/97
61092 4/1983 Japan ..... 114/39.2
8101805 11/1982 Netherlands ..... 114/39.2

OTHER PUBLICATIONS

Nautix Product Information Brochure.
"Windsurfing Magazine", Mar. 1992 Issue; Item 5, p. 102.
"Windsurfing Magazine", Apr. 1992 Issue.
"Windsurfing Magazine", May 1992 Issue; p. 86.

*Primary Examiner*—Jesus D. Sotelo
*Attorney, Agent, or Firm*—Jones, Tullar & Cooper

[57] ABSTRACT

A quick-connect, outhaulless boom end is adjustably secured to boom spars of a sailboard boom. The boom end terminates in a forward of leech position with respect to the sailboard's sail. A clew tube or rod coacts with the sail in the forward of leech position to position the sail between the two spaced boom spars.

17 Claims, 4 Drawing Sheets

FIG. 7
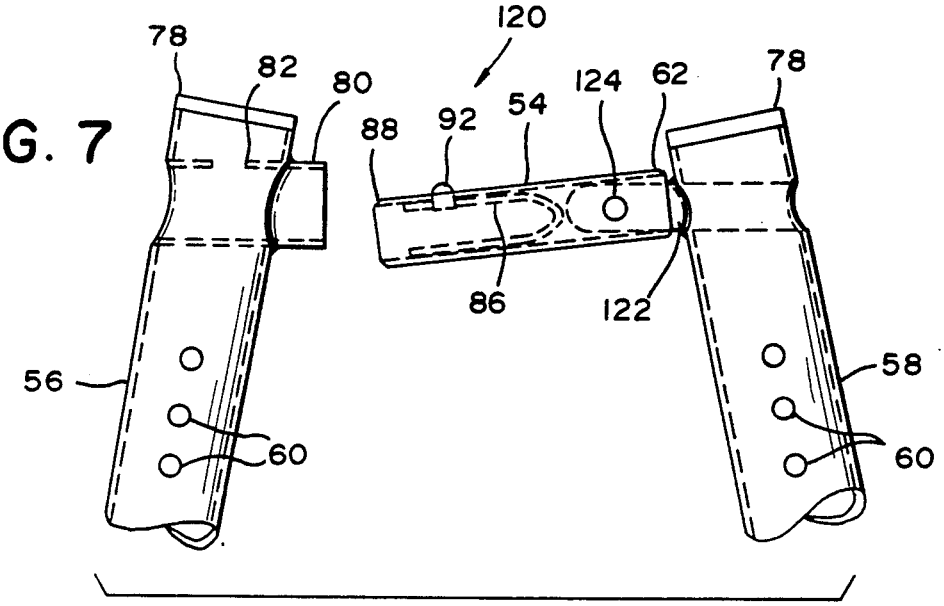
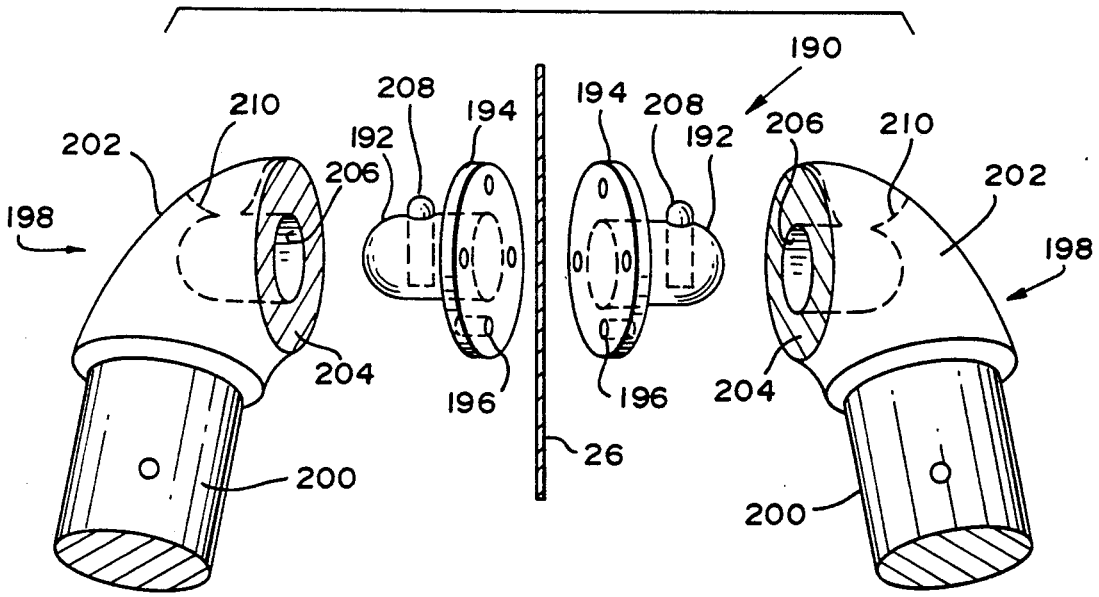
FIG. 10

FIG. 8
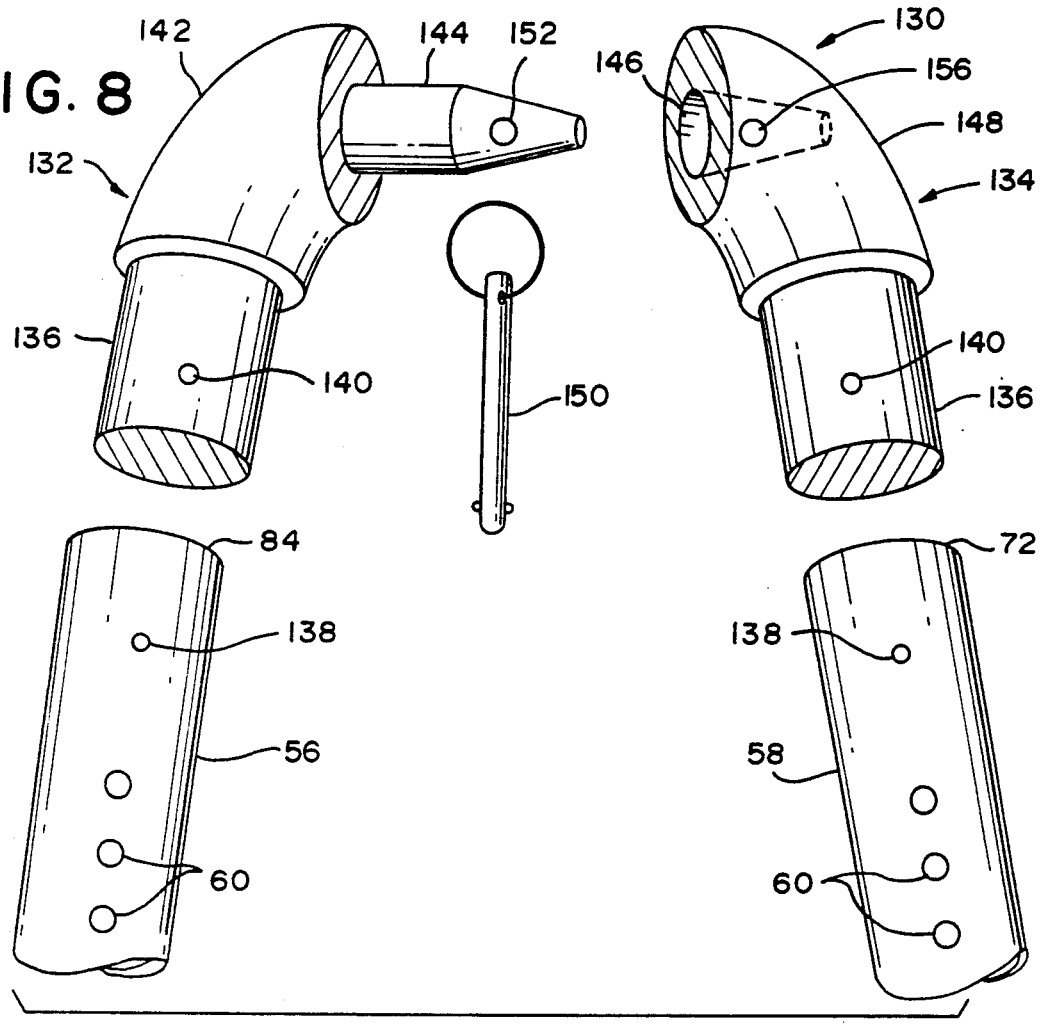
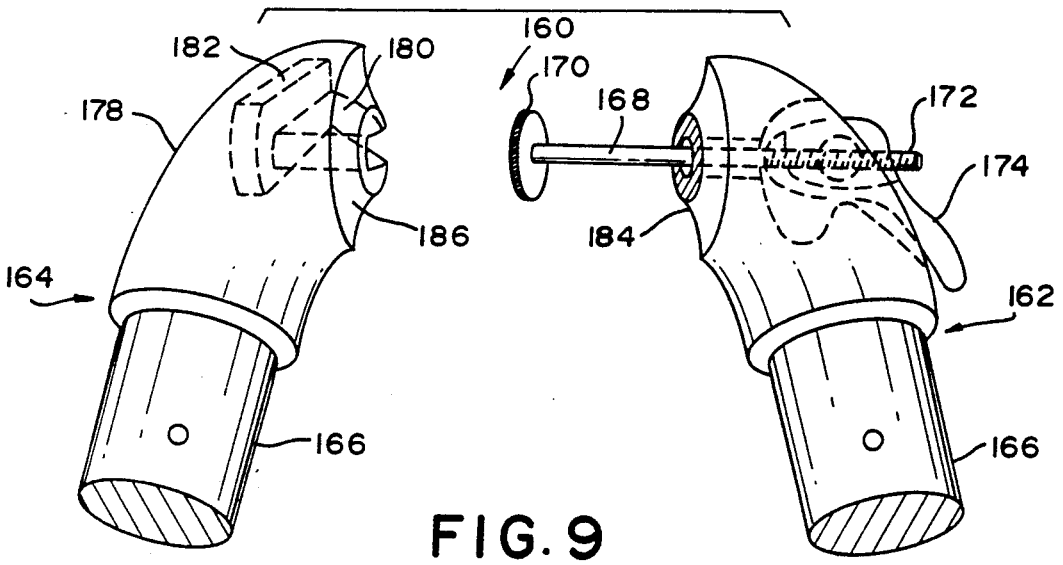
FIG. 9

QUICK-CONNECT BOOM END

FIELD OF THE INVENTION

The present invention is directed generally to a quick-connect boom end. More particularly, the present invention is directed to a quick-connect outhaulless boom end. More specifically, the present invention is directed to a quick-connect, outhaulless boom end for a sailboard. The boom end is securable to the main boom spars of a sailboard boom, and passes through a clew grommet at a forward of leech position or attaches to clew fasteners at a forward of leech position of the sailboard sail. The end of the quick-connect outhaulless boom end does not extend beyond the clew of the sail. The amount of time required to rig the boom is significantly less than needed when using conventional boom ends.

DESCRIPTION OF THE PRIOR ART

The sport of windsurfing has developed tremendously in the last twenty-five years. Early windsurfers were modified surfboards which used a mast, boom and sail that were similar to their equivalents on conventional sailboats. In the past all racing sails required considerable outhaul tension for proper shape. With sailboards, this was accomplished using a boom end with a rope outhaul line. Early sailboards developed about twenty-five years ago used rope to tie each boom end together and to outhaul the sail. During the past ten years, battens have been used increasingly on windsurfing sails. If a sail using battens is built correctly, little or no outhaul tension is required to maintain proper sail shape.

Properly constructed battened sails do not require outhaul tension for proper shape. However, sails have been outhauled by rope and block for so long that manufacturers continue to make the same type of boom end; and sailors continue to rig these newer sails with a rope outhaul line to attach but not tension the clew to the standard type boom end. This continues the disadvantage of using rope, which can break, and excess line, which must be tied down. A rope outhaul is slower to rig and results in play in the connection. This type of boom end is also heavy and extends beyond the rear of the sail. This adds weight, excess swing radius and results in slower jibes. It can also cause the boom end to drag in the water during a lay-down jibe, and the added weight and length of the prior art boom ends make water starts, where wind and sail lift the sailor out of the water to a standing position on the moving board, more difficult. It also causes other maneuvers to be slower and more difficult.

Several prior art patents are exemplary of the boom ends that are in use with typical wishbone booms on windsurfers or sailboards. These are U.S. Pat. No. 4,635,579 to Marker et al; U.S. Pat. No. 4,696,248 to Nedoluha; and U.S. Pat. No. 5,095,838 to Smith. In these prior devices, the boom ends, after having been coupled with the two spars of the main body of the wishbone boom, extend to the rear past the end of the sail. The clew of the sail is attached to the boom end using a rope outhaul line that must be passed through a block or pulley attached to the clew, then threaded through and over various combinations of pulleys and guides and finally secured by means of a cleat or other securing device. In all of these prior devices, the boom end extends aft of the clew portion of the sail with the attendant limitation as discussed above.

It will be apparent that a need exists for a boom end which will overcome the limitation of the prior art devices. The quick-connect outhaulless boom end of the present invention provides such a device and is a significant improvement over the prior art devices.

SUMMARY OF THE INVENTION

It is an object of the present invention to provide a quick-connect boom end.

Another object of the present invention is to provide a quick-connect outhaulless boom end.

A further object of the present invention is to provide a quick-connect, outhaulless boom end for a sailboard.

Yet another object of the present invention is to provide a quick-connect boom end for a battened sail.

Still a further object of the present invention is to provide a quick-connect boom end which passes through a clew grommet forward of the leech of the sail.

Even yet another object of the present invention is to provide a quick connect boom end which is attachable to a battened sail forward of the leech.

Still yet a further object of the present invention is to provide a quick-connect boom end which is lighter and stiffer than prior boom ends.

As will be discussed in detail in the description of the preferred embodiments which are set forth subsequently, the quick-connect outhaulless boom end in accordance with the present invention passes through a clew grommet or attaches to a clew fitting which is positioned on the sail forwardly of the leech of the sail. In one embodiment, the boom end utilizes a clew tube or pin which can be secured to one side of the boom end, passed through a clew grommet which is forward of the leech of the sail, and releasably secured to the other side of the boom end. In a second embodiment, the boom end is attached to either side of the clew portion of the sail forward of the leech position. The boom end of the present invention can also be used with sails that do not have battens by attachment of the sail's outhaul line to a jamb cleat attached to the boom end.

The quick-connect, outhaulless boom end of the present invention replaces the traditional prior art boom end and rope outhaul line with a boom end that eliminates the outhaul line and the usual portion of the boom end which extends beyond the clew. One advantage of this invention is noticed upon first rigging the sail. With the present quick-connect boom end, the user presses a spring release pin, opens the boom end, slices its clew tube through the clew grommet and closes the boom end back in to place.

The present invention also cuts down on rigging time since there is no lacing of outhaul line through pulleys and cleats. Outhauling, when necessary, can be accomplished by micro-adjusting the boom length. There are other advantages besides ease of rigging and no rope to break. By eliminating the rope outhaul and connecting through the clew or to some connecting fixture at a clew position, the overall boom length is shorter, making the boom lighter, stiffer and stronger. This reduces leech tension for head twist and keeps draft forward, balanced and controlled, and reduces or eliminates boom-end drag in the water during lay-down jibes and other maneuvers. The result is easier and faster water starts and sailing.

Another advantage of the quick-connect boom end of the present invention is that since no outhaul tension is required on correctly built battened sails, the clew grommet no longer needs to be placed at the rear end of the clew of the sail. The present boom end allows moving the clew grommet forward a considerable distance without changing the outline or shape of the sail. The sail then extends to the rear of the clew grommet by as much as two feet. When the boom end is attached in this position, unexpected sailing characteristics emerge. The boom becomes considerably lighter and stiffer. Swing radius for the boom is much shorter and allows much easier jibes and other maneuvers. Wind gusts do not overpower the sailor as easily since the boom is shorter.

The quick-connect outhaulless boom end of the present invention overcomes the limitation of the boom ends that are presently available. It reduces rigging time, eliminates unneeded lines, improves sailing and handling characteristics and increases the stiffness and strength of the boom. The boom end of the present invention is a substantial advance in the art.

BRIEF DESCRIPTION OF THE DRAWINGS

While the novel features of the quick-connect boom end of the present invention are set forth with particularity in the appended claims, a full and complete understanding of the invention may be had by referring to the detailed description of the preferred embodiments which are presented subsequently, and as illustrated in the accompanying drawings, in which:

FIG. 7 is a top plan view of a third preferred embodiment of a quick-connect boom end in the open position;

FIG. 8 is a top plan view of a fourth preferred embodiment of a quick-connect boom end;

FIG. 9 is a top plan view of a fifth preferred embodiment of a quick-connect boom end; and FIG. 10 is a top plan view of a sixth preferred embodiment of a quick-connect boom end in accordance with the present invention.

DETAILED DESCRIPTION OF PREFERRED EMBODIMENTS

Figure 1:
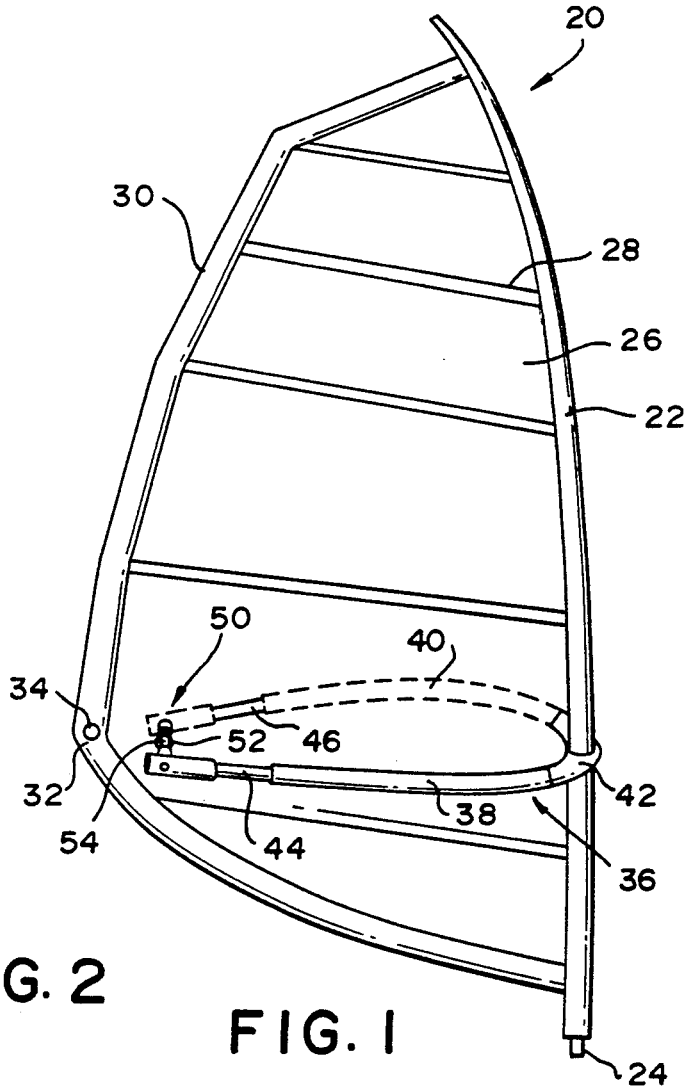
FIG. 1 is a side elevation view of a sailboard sail assembly utilizing the quick-connect boom end of the present invention.

Referring initially to FIG. 1, there may be seen generally at 20 a sailboard sail assembly which utilizes the quick-connect outhaulless boom end of the present invention. Sailboard sail assembly 20 includes a mast 22 which would be attached at its lower end 24 to a sailboard or windsurfer which is not specifically shown. A fully battened sail 26 which carries a plurality of battens 28 is attached to the mast in a generally conventional manner. The sail 26 has a leech portion 30 and a clew 32 which is the lower corner of a fore and aft sail of the type shown at 20 in FIG. 1. A clew grommet 34 is placed in the sail 26. The sail 26 has an uphaul and/or a downhaul that is used to tension the forward, vertical edge of the sail 26 on the mast 22. The battens 28 provide tension in a fore and aft direction. This sail 26 is generally known in the art.

A wishbone boom assembly, generally at 36 has a pair of boom spars 38 and 40 which converge at their forward ends in a mast clamp 42. Extension tubes 44 and 46 extend rearwardly from aft end portions of the boom spars 38 and 40. A quick-connect, outhaulless boom end, generally at 50, in accordance with the present invention, is removably and adjustably secured to the boom extensions 44 and 46 as will be discussed in detail shortly. As may be seen clearly in FIG. 1, the quick-connect boom end 50 terminates forwardly of the clew 32 of sail 26. A forward of leech clew grommet 52 is provided in sail 26. This forward of leech clew grommet 52 forms an opening in the sail 26 through which a clew tube or rod 54 will pass when the quick-connect outhaulless boom end 50 of the present invention is used. Since the sail 26 shown in FIG. 1 utilizes properly placed battens 28 in accordance with present sail designs, little or no outhaul tension is required to maintain proper shape of sail 26. The quick-connect, outhaulless boom end 50 of the present invention thus does not need to exert a substantial outhaul tension of the sail 26. By placing the boom end 50 of the present invention in the forward of leech clew grommet 52 in the manner depicted in FIG. 1, the advantages discussed previously will be realized.

Figure 3:
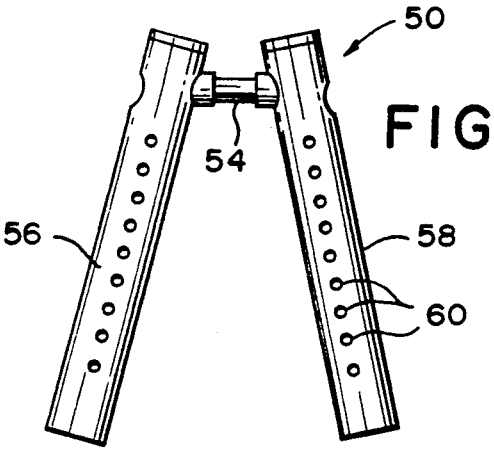
FIG. 3 is a top plan view of a first preferred embodiment of a quick-connect boom end in the closed position.
Figure 4:
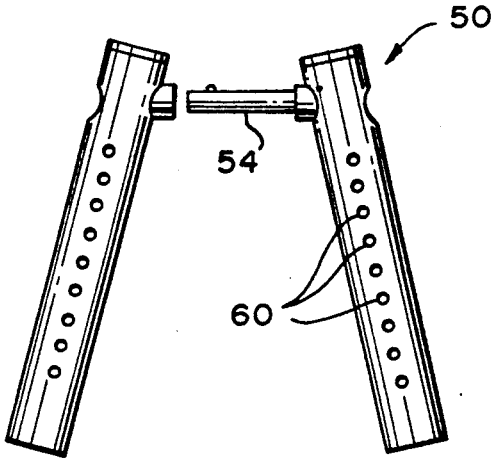
FIG. 4 is a view similar to FIG. 3 with the boom end open.
Figure 2:
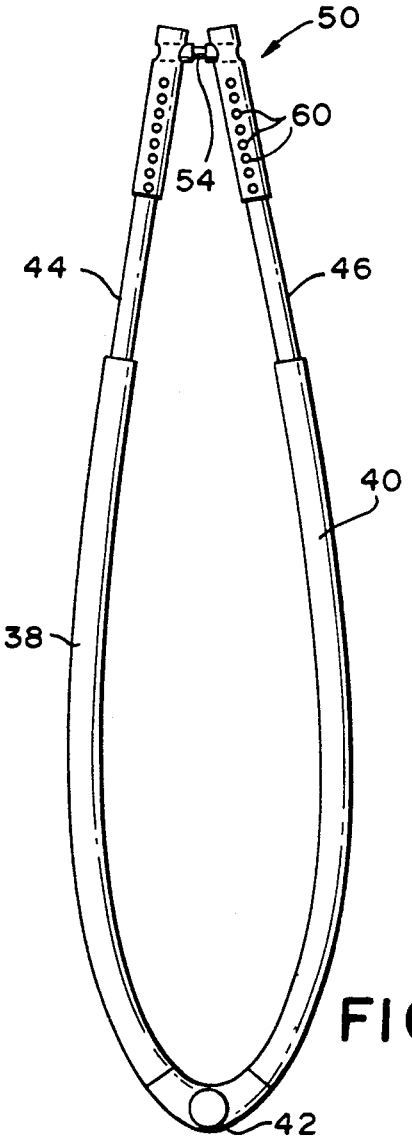
FIG. 2 is a top plan view of a sailboard wishbone boom with the present invention.
Figure 5:
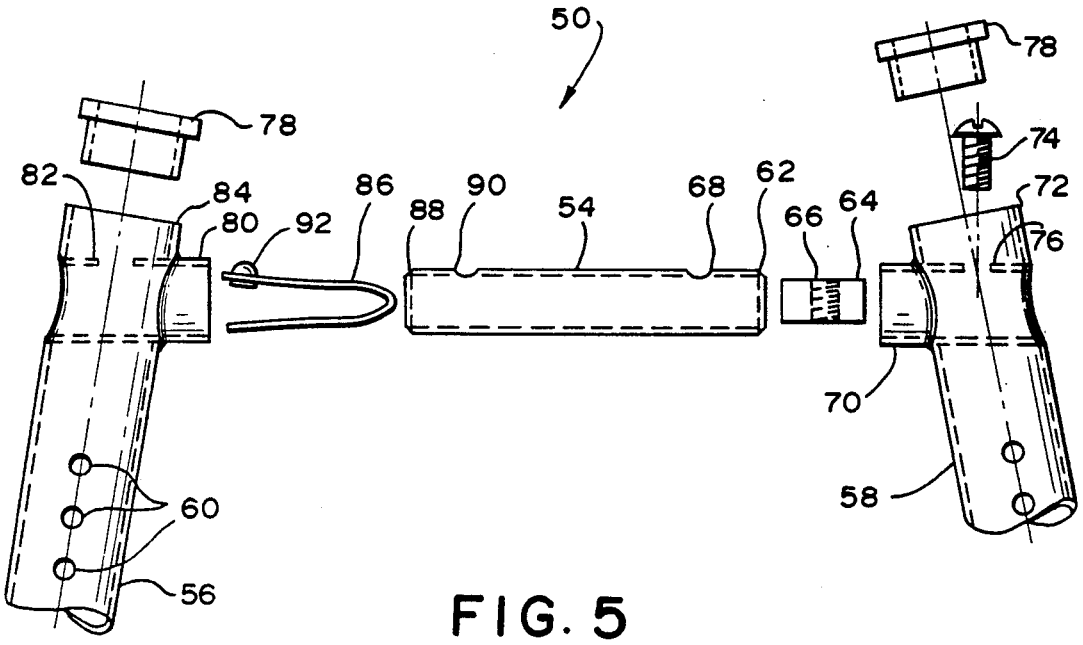
FIG. 5 is an exploded top plan view of the first preferred embodiment of a quick-connect boom end.

Turning now to FIGS. 2–5, a first preferred embodiment of the quick-connect, outhaulless boom end 50 of the present invention will be discussed in detail. Boom end 54 utilizes left and right boom end tubes 56 and 58 which, as may be seen more clearly in FIG. 5, are hollow aluminum tubes that in the preferred embodiments have an outer diameter of 1⅛", an inner diameter of 1" and a length of 10" to 15". Each boom end 56 or 58 has a plurality of longitudinally spaced micro-adjusting holes 60 which allow the boom end tubes 56 and 58 to be adjustably positioned along the boom extension tubes 44 and 46 by use of suitable spring pins or the like which ar not specifically shown. The micro-adjusting holes 60 allow the boom end 50 to be adjusted longitudinally fore and aft to properly position the clew tube 54 in the forward of leech clew grommet 52 of various sized sails 26. As will be discussed in detail subsequently, the length of the boom end tubes 56 and 58, and the use of the plurality of micro-adjusting holes also allows the boom end 50 to be utilized with sails 26 that do not have battens 28 and thus require an outhaul to provide suitable sail tension.

The quick-connect, outhaulless boom end 50 is structured so that the clew tube 54 is securely attached to a first boom end tube and is releasably engageable with a second boom end tube. Thus, the boom end 50 can be closed, as depicted in FIG. 3 which would be its use position, or opened, as depicted in FIG. 4, which would be its rigging position. In the open or rig position shown in FIG. 4, the two boom end tubes 56 and 58 are separable and the clew tube 54 can be slid through the forward of leech clew grommet 52. Once the clew tube 54 has been slid through the grommet 52, the boom ends 50 will be closed, as shown in FIG. 3.

As may be seen most clearly in FIG. 5, the clew tube 54 is a hollow tube that may be made of aluminum with an inner diameter of ½", an outer diameter of 9/16" and a length of 3⅜". A first end 62 of clew tube 54 receives a plastic insert or dowel 64 that may be made of DEL- RIN ® or the like. This insert 64 has a threaded bore 66 which is alignable with an aperture 68 placed adjacent the first end 62 of the clew tube 54. A clew tube coupling socket 70 in the form of a hollow tube is welded into the end of the right boom end tube 58 adjacent its free end 72. This socket 70 is sized to telescopingly receive the first end 62 of the clew tube 54. A suitable bolt or screw 74 can be inserted through a bore 76 in socket tube 70 and into the plastic insert 64 to secure the first end 62 of the clew tube 54 in the right boom end tube 58. A plastic insert 78 may be placed in the end 72 or the boom end tube 58. A clew tube receiving sleeve 80 is welded or otherwise securely attached to the left boom end tube 56. This sleeve 80 is the same size as socket 70 and includes a pin receiving bore 82 which, as seen in FIG. 5 is located within the hollow boom end tube 56 and generally adjacent and facing an open, free end 84 of boom end tube 56. A plastic insert 78 may also be placed in tube end 84, it being understood that insert 78 has an open end. A suitable spring pin 86 is slidably received in an open second end 88 of clew tube 54. A pin aperture 90 adjacent second end 86 allows a pin portion 92 of spring pin 86 to project out through the side wall of the clew tube 54 and to be receivable in the pin receiving bore 82 in the clew tube receiving sleeve 80 when the second end 88 of the clew tube 54 is inserted therein.

The boom end 50 will be held in its closed position, as depicted in FIG. 3 when the clew tube end 88 is inserted in the sleeve 80. It will be movable to the rig position depicted in FIG. 4 when the pin 92 is depressed and the clew tube 54 is withdrawn from the sleeve 80. It will be understood that in this first preferred embodiment of a quick-connect outhaulless boom end 50, as well as in the several other preferred embodiments to be discussed subsequently, that the references to "left" and "right" are for ease of the descriptions and that the subject invention is equally useable when the clew tube 54 is secured to either the left or right boom end tube 56 or 58 and is slidable into either the right or left tube 58 or 56. Either orientation is appropriate and the one selected by an individual sailor will depend on his or her personal preference. The appropriate orientation may be accomplished simply by turning the entire boom over.

Figure 6:
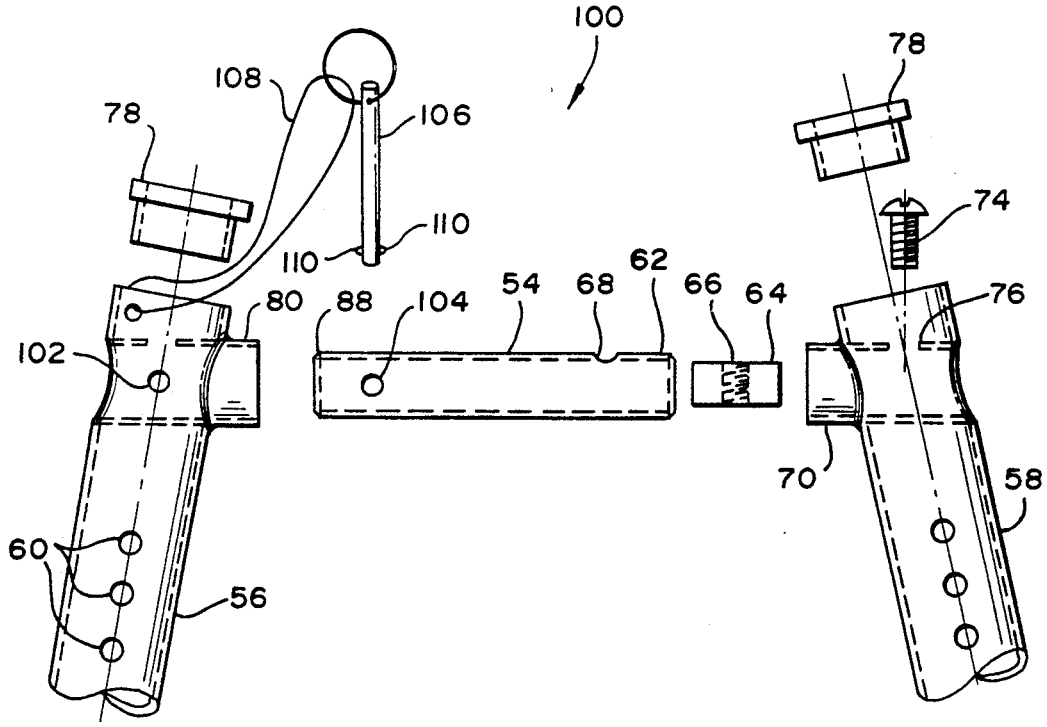
FIG. 6 is an exploded top plan view of a second preferred embodiment of a quick-connect boom end.

Turning now to FIG. 6, there may be seen, generally at 100 a second preferred embodiment of a quick-connect, outhaulless boom end in accordance with the present invention. This second embodiment is similar to the first embodiment except in its mean for releasably securing the clew tube 54 in the clew tube receiving sleeve 80. In this second embodiment, in which the same reference numerals are used for elements common to both embodiments, the clew tube receiving sleeve 80 and the overlying boom end tube 56 are provided with a through bore 102. This through bore 102 is alignable with a similar clew tube through bore 104 that is adjacent the second end 88 of clew tube 54. It will be noted that the axes of these through bores 102 and 104 are generally vertical, in contrast to the axes of the pin receiving bore 82 discussed with the first embodiment. A quick pin 106 is attached by a suitable lanyard 108 to the end of the left boom end tube 56. Once the clew tube end 88 has been inserted into the receiving sleeve 80, the quick pin 106 can be inserted through the aligned bores 102 and 104 to hold the boom end 100 in its closed position. Suitable spring-biased balls 110 act to prevent the quick pin 106 from being inadvertently pulled out of the aligned bores 107 and 104.

A third preferred embodiment of a quick-connect, outhaulless boom end, generally at 120, in accordance with the present invention is shown in FIG. 7. In this third preferred embodiment, the clew tube 54 is pivotably attached to the right boom end tube 58 in a manner which will allow its clew tube receiving sleeve engaging end 88 to be moved fore or aft slightly. This is accomplished by substituting a solid clew rod 122 for the clew tube coupling socket 70 of the first and second embodiments. This clew rod is welded or otherwise securely attached to the right boom end tube 58 and extends toward the left boom end tube 56. A generally vertical bore is placed in the portion of the clew rod 122 which extends toward left boom end tube 50. An alignable bore 124 is formed near the right end 62 of clew tube 54. A swivel pin or rivet 126 is passed through bore 124 in clew tube 54 and the aligned bore in the clew rod 122. This allows the angle of the clew tube 54 to be varied slightly with respect to the axis of the clew tube receiving sleeve 80. In the first and second preferred embodiments, the socket 70 and the sleeve 80 are secured to the boom end tube 58 and 56, respectively at first angles of generally 100°. In the third preferred embodiment 120, the use of the swivel connection between the clew tube 54 and the boom end tube 58 allows to clew tube 54 to be pivoted slightly to compensate for slight non-alignments between the forward of leech clew grommet 52 and the clew tube 54.

Referring now to FIG. 8, there may be seen, generally at 130, a fourth preferred embodiment of a quick-connect, outhaulless boom end in accordance with the present invention. In this fourth preferred embodiment, a molded plastic male boom end piece 132 is secured to the free end 84 of the left boom end tube 56 and a molded plastic female boom end piece 134 is secured to the free end 72 of the right boom end tube 58. Each boom end piece has a stub shank 136 which slides into the hollow boom end tube 56 or 58 and is secured by a suitable rivet or other fastener that is inserted through an aperture 138 in the end tube 56 or 58 and received in a bore 140 in the stub shank 136. The male end piece 132 has a main body 142 which is generally elbow-shaped and which is formed having a clew pin or tube 144 that extends generally toward a cooperatively shaped clew pin receiving aperture 146 that is formed in an elbow-shaped main body 148 of the molded plastic female boom end piece 134. A quick pin 150 is insertable through aligned bores 152 in a free end 154 of clew pin 144 and 156 in the main body 148 of the female boom end piece 134 to hold the quick-connect, outhaulless boom end 130 in a closed position As was the case with prior embodiments, the position of the male and female boom end pieces 137 and 134 can be reversed with respect to the boom end tubes 56 and 58 in accordance with the individual user's preference.

A fifth preferred embodiment of a quick-connect, outhaulless boom end in accordance with the present invention is shown generally at 160 in FIG. 9. This fifth preferred embodiment is somewhat similar to the fourth preferred embodiment, generally at 130 since it uses male and female molded plastic boom end pieces, generally at 162 and 164, respectively. Each of these boom end pieces 162 and 164 has a stub shank 166 which is insertable into the free end of a boom end tube that is not specifically shown. In the fifth embodiment, the clew pin or tube 168 carries an enlarged disk 170 at its free end. The opposite end 172 of the clew pin 168 is threaded and is adjustably secured to a cam tensioner 174. This cam tensioner is pivotally attached to the elbow-shaped main body 176 of the male boom end piece 162. As the cam tensioner 174 is moved through generally 90° in a known manner, the clew pin 168 will move toward or away from the female boom end piece 164. This female end piece 164 has an elbow-shaped main body 178 that is formed with a clew pin receiving slot 180 and a clew pin disk receiving channel 182. In use, the clew pin 168 is inserted through the forward of leech clew grommet 52 and the clew pin disk 170 is slid into the clew pin disk receiving channel 182. The clew pin 168 is received in the slot 180 and the cam tensioner 174 is pivoted to pull on the clew pin 168 to thereby draw the two boom end pieces 162 and 164 toward each other. Inwardly facing end surfaces 184 and 186 of the male and female boom end pieces 162 and 164, respectively are somewhat cone-shaped. It will be understood that the forward of leech clew grommet 52 will be sized so that it will fit in the reduced diameter waist portion created by the two cone-shaped end surfaces 184 and 186.

A sixth preferred embodiment of a quick-connect outhaulless boom end in accordance with the present invention is shown generally at 190 in FIG. 10. In this sixth preferred embodiment, the sail does not have a forward of leech clew grommet. Instead, a pair of plastic clew rods or tubes 192 are provided with integral enlarged flanges 194 which sandwich a section of the sail 26 between them. These enlarged flanges 194 are provided with aligned openings 196 so that suitable rivets or other fasteners can be passed therethrough to secure the two clew rods or tubes 192 to opposite sides of the sail 26. A molded plastic female boom end piece 198 is securable to the free end of each one of the boom end tubes (not shown) in a manner similar to that discussed with the fourth and fifth embodiments. Each boom end piece 198 has a stub shank 200 which is insertable into the boom end tube. Each boom end piece 198 also has a generally elbow-shaped main body portion 202. Inwardly facing ends 204 of the body portions 202 are provided with clew rod or tube receiving apertures 206. These apertures 206 are each sized to receive a cooperatively sized one of the clew rods or tubes 192. As may be seen in FIG. 10, each of the clew rods 192 carries a spring-biased ball 208 generally adjacent its free end. An access opening 210 in each of the main bodies 202 of the end pieces 198 communicates with the corresponding clew rod receiving aperture 206. Each boom end attaches to its corresponding clew rod or pin 192 which is, in turn, securely attached to the sail 26. When it is desired to release a boom end from its clew pin, the spring-biased ball 208 can be depressed through access opening 210 thereby allowing the associated clew pin 192 to be separated from the associated aperture 206.

In the several preferred embodiments of the quick-connect outhaulless boom end discussed above, the ends of the boom are located at a forward of leech position and, with the exception of the sixth preferred embodiment, include a clew tube or rod which passes through a forward of leech clew grommet. The quick-connect boom end of the present invention can also be adapted for use with a sail that utilizes an outhaul. This can be done by moving the boom ends aft or rearwardly through use of the micro-adjusting holes until the clew tube or rod is in an aft of clew position. The outhaul line can then be run from the clew grommet, around the clew tube, back through the clew grommet, around the clew tube on the other side of the sail and secured to the jamb cleat that is attached to one of the boom end tubes. While such an arrangement will not provide the advantages of the present invention, it may be necessary to adapt the quick-connect boom end of the present invention in such a manner so that a sailboard owner can use battened sails as well as sails with an outhaul with the same boom.

While preferred embodiments of a quick-connect outhaulless boom end in accordance with the present invention have been set forth fully and completely hereinabove, it will be apparent to one of skill in the art that a number of changes in, for example, the overall size of the boom, the types of materials used, the types of finishes applied to the materials and the like could be made without departing from the true spirit and scope of the present invention which is accordingly to be limited only by the following claims.

I claim:

1. A quick-connect boom end assembly for a sailboard wishbone boom, said quick connect boom end assembly comprising:

first and second boom ends securable to boom spars of said sailboard wishbone boom, said first and second boom ends terminating in free ends in a forward of leech position with respect to a sail usable with said boom end; and means on said first and second boom ends for connecting a forward of leech portion of a sail to said quick-connect boom end assembly, said means including a clew tube, said clew tube extending between said first and second boom ends through a forward of leech clew grommet in a sail.

2. The quick-connect boom end assembly of claim 1 wherein a first end of said clew tube is secured to said first boom end and a second end of said clew tube is releasably engageable with said second boom end.

3. The quick-connect boom end assembly of claim 2 wherein said first end of said clew tube is secured to a clew tube coupling socket in said first boom end.

4. The quick-connect boom end assembly of claim 3 wherein said second end of said clew tube carries a spring pin, said spring pin being releasably receivable in a clew tube receiving socket in said second boom end.

5. The quick-connect boom end assembly of claim 2 wherein said second end of said clew tube is releasably engageable with a clew tube receiving sleeve in said second boom end by means of a quick release pin.

6. The quick-connect boom end assembly of claim 2 wherein said free end of said clew tube is secured to said first boom and by a cam tensioner.

7. The quick-connect boom end assembly of claim 6, wherein said second end of said clew tube carries a disk and further wherein said disk is releasably receivable in a clew disk receiving channel in said second boom end.

8. The quick-connect boom end assembly of claim 6 wherein said first end of said clew tube is threaded for adjustable securement to said can tensioner.

9. The quick-connect boom end assembly of claim 1, wherein said first and second boom ends are secured to first and second boom end tubes.

10. The quick-connect boom end assembly of claim 9 wherein said first and second boom end tubes are telescopingly slidable with respect to said boom spars.

11. A quick-connect boom end assembly for a sailboard wishbone boom, said quick connect boom end assembly comprising:

first and second boom ends securable to boom spars of said sailboard wishbone boom, said first and second boom ends terminating in free ends in a forward of leech position with respect to a sail usable with said boom end; and means on said first and second boom ends for connecting a forward of leech portion of a sail to said quick-connect boom end assembly, said means including first and second clew rods, said first and second rods being attachable to opposing sides of a sail.

12. The quick-connect boom end assembly of claim 11 wherein each of said first and second clew rods includes a free end extending outwardly from a sail.

13. The quick-connect boom end assembly of claim 12 further wherein said first and second boom ends have clew rod receiving apertures, each of said clew rod receiving apertures being sized to receive a cooperating one of said free ends of said first and second clew rods.

14. A quick-connect boom end assembly for a sailboard wishbone boom, said quick connect boom end assembly comprising:

first and second boom ends securable to boom spars of said sailboard wishbone boom, said first and second boom ends terminating in free ends in a forward of leech position with respect to a sail usable with said boom end; and means on said first and second boom ends for connecting a forward of leech portion of a sail to said quick-connect boom end assembly, said means including a clew tube having first and second ends, said clew tube extending between said first and second boom ends through a sail, said first end of said clew tube being pivotably secured to a clew rod attached to said first boom end and said second end of said clew tube being releasably engageable with said second boom end.

15. The quick-connect boom end assembly of claim 14 wherein said second end of said clew tube carries a spring pin, said spring pin being releasably receivable in a clew tube receiving socket in said second boom end.

16. A quick-connect boom end assembly for a sailboard wishbone boom, said quick connect boom end assembly comprising:

first and second boom ends securable to boom spars of said sailboard wishbone boom, said first and second boom ends terminating in free ends in a forward of leech position with respect to a sail usable with said boom end; and means on said first and second boom ends for connecting a forward of leech portion of a sail to said quick-connect boom end assembly, said means including a clew tube having first and second ends, said clew tube extending between said first and second boom ends through a sail, said first end of said clew tube being formed integrally with said first boom end and said second end of said clew tube being releasably receivable in a clew tube receiving aperture formed integrally with said second boom end.

17. The quick-connect boom end assembly of claim 16 wherein said first and second boom ends are molded plastic.

* * * * *